US009056239B2

(12) United States Patent
Girard et al.

(10) Patent No.: US 9,056,239 B2
(45) Date of Patent: Jun. 16, 2015

(54) ASSEMBLY INCLUDING A GLIDING BOARD AND A DEVICE FOR RETAINING AN ARTICLE OF FOOTWEAR

(71) Applicant: SALOMON S.A.S., Metz-Tessy (FR)

(72) Inventors: Francois Girard, Veyrier du Lac (FR); Eddy Yelovina, Epagny (FR); Remy Saillet, Gruffy (FR)

(73) Assignee: SALOMON S.A.S., Metz-Tessy (FR)

( * ) Notice: Subject to any disclaimer, the term of this patent is extended or adjusted under 35 U.S.C. 154(b) by 0 days.

(21) Appl. No.: 14/161,220

(22) Filed: Jan. 22, 2014

(65) Prior Publication Data

US 2014/0131980 A1 May 15, 2014

Related U.S. Application Data

(63) Continuation of application No. 12/385,380, filed on Apr. 7, 2009, now Pat. No. 8,662,524.

(30) Foreign Application Priority Data

Apr. 8, 2008 (FR) ..... 08 01926
Sep. 15, 2008 (FR) ..... 08 05045

(51) Int. Cl.
*A63C 9/00* (2012.01)
*A63C 5/00* (2006.01)

(52) U.S. Cl.
CPC . *A63C 9/00* (2013.01); *A63C 5/003* (2013.01); *A63C 9/003* (2013.01)

(58) Field of Classification Search
CPC ..... A63C 9/006; A63C 9/00; A63C 9/0844; A63C 13/008
USPC ..... 280/607, 11.12, 11.3, 601, 611, 612, 280/613, 602, 614, 615, 617, 618
See application file for complete search history.

(56) References Cited

U.S. PATENT DOCUMENTS

| | | | | |
|---|---|---|---|---|
| 3,675,938 | A | 7/1972 | Sigl | |
| 4,487,427 | A | 12/1984 | Salomon | |
| 4,792,156 | A | 12/1988 | Hue | |
| 4,997,198 | A | 3/1991 | Provence et al. | |
| 5,026,086 | A * | 6/1991 | Guers et al. | 280/607 |
| 5,082,410 | A | 1/1992 | Provence | |
| 5,085,454 | A | 2/1992 | Provence et al. | |
| 5,088,756 | A | 2/1992 | Hue et al. | |
| 5,090,723 | A | 2/1992 | Arnulf | |
| 5,669,622 | A * | 9/1997 | Miller | 280/615 |
| 5,794,963 | A | 8/1998 | Girard | |

(Continued)

FOREIGN PATENT DOCUMENTS

| | | |
|---|---|---|
| EP | 0 753 330 A1 | 1/1997 |
| EP | 1 325 767 A1 | 7/2003 |

(Continued)

*Primary Examiner* — Brodie Follman
*Assistant Examiner* — Bryan Evans
(74) *Attorney, Agent, or Firm* — Greenblum & Bernstein, P.L.C.

(57) ABSTRACT

An assembly including a gliding board and a device for retaining an article of footwear on the board, the device extending longitudinally from a rear end to a front end, the board having a receiving zone provided to receive the retaining device longitudinally in relation to the board. The assembly includes a wedge device which inclines the retaining device longitudinally in relation to the board, so that the retaining device is angled downwardly from the front end to the rear end.

33 Claims, 10 Drawing Sheets

(56) References Cited

U.S. PATENT DOCUMENTS

| | | | | |
|---|---|---|---|---|
| 5,884,934 | A | 3/1999 | DeRocco et al. | |
| 5,915,718 | A | 6/1999 | Dodge | |
| 6,371,506 | B1 | 4/2002 | DeNicola | |
| 6,715,782 | B2 | 4/2004 | Sosin et al. | |
| 2006/0103112 | A1 | 5/2006 | Redor et al. | |
| 2006/0232045 | A1 | 10/2006 | Schary et al. | |
| 2007/0138765 | A1 * | 6/2007 | Miette et al. | 280/615 |
| 2007/0187926 | A1 | 8/2007 | Schary et al. | |
| 2007/0273127 | A1 | 11/2007 | Girard et al. | |

FOREIGN PATENT DOCUMENTS

| | | | |
|---|---|---|---|
| EP | 1 797 931 | A1 | 6/2007 |
| FR | 2 634 133 | A1 | 1/1990 |
| FR | 2 701-854 | A1 | 9/1994 |
| WO | WO-02/11830 | A2 | 2/2002 |

* cited by examiner

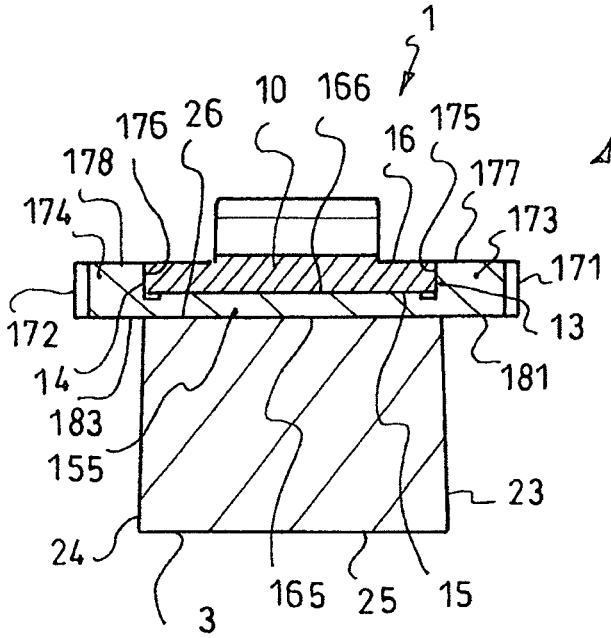
Fig: 10
Fig: 11
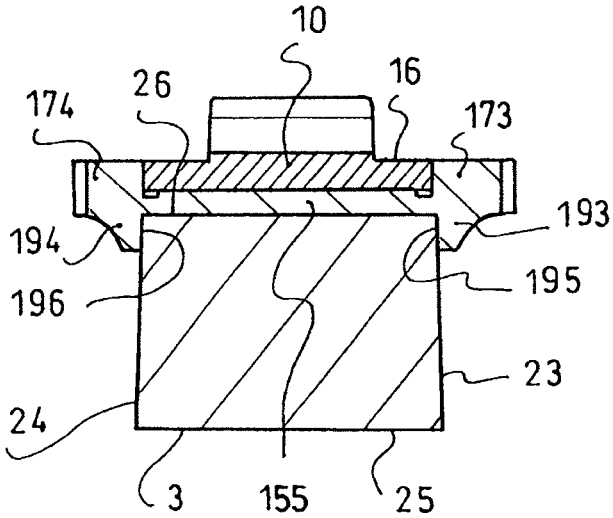

ASSEMBLY INCLUDING A GLIDING BOARD AND A DEVICE FOR RETAINING AN ARTICLE OF FOOTWEAR

CROSS-REFERENCE TO RELATED APPLICATIONS

This application is a continuation of U.S. patent application Ser. No. 12/385,380, filed on Apr. 7, 2009, the disclosure of which is hereby incorporated by reference thereto in its entirety and the priority of which is hereby claimed under 35 U.S.C. §120.

This application is based upon the French priority Patent Applications No. 08.01926, filed Apr. 8, 2008, and Patent No. 08.05045, filed Sep. 15, 2008, the disclosures of which are hereby incorporated by reference thereto, and the priorities of which are hereby claimed under 35 U.S.C. §119.

BACKGROUND

1. Field of the Invention

The invention refers to assemblies that include a gliding board and a device for retaining an article of footwear.

Such assemblies are adapted for the practice of sports, such as cross-country skiing, telemark skiing, downhill skiing, and any other kind of skiing, as well as snowshoeing, and the like.

2. Background Information

In the assemblies of the aforementioned types, the retaining device extends longitudinally, from a rear end to a front end, the board having a receiving zone provided to receive the retaining device longitudinally. Thus, when operating the board, a user can apply supporting forces, exert pushing forces, return forces, guiding forces, and other.

This translates into the transmission of steering impulses and sensory information for each board, as well as in the retaining device and the boot which are associated therewith.

An example comes from cross-country skiing. In this case, the boot is retained by the tip, the heel being free to move alternately away from and toward the board.

In the case of skating steps, the user applies lateral pushing forces and forward return forces alternately with each leg. During the lateral push, the ski is pressed flat on the ground and glides obliquely in relation to the advance direction. The pushing force is efficient when the ski glides without skidding. This is where efficiency is the highest, as all of the energy related to the push moves the user forward. However, this is not always the case, in the sense that the ski skids sometimes, and that efficiency is negatively affected. The same is true during a forward return of the ski during such skating steps. An interference occurs sometimes between the ski and the ground. For example, if the ski is not sufficiently parallel to the ground, one of its ends can drag on the ground. This negatively affects steering efficiency, causes unnecessary fatigue, and can even throw the user out of balance.

When using alternate steps, also known as classic skiing, the skier alternately thrusts each ski forward, and then takes vertical support by pushing, or applying an impulse, towards the ground, in a repetitive fashion. During a thrust, one ski glides longitudinally on the ground, in the forward direction. The thrust is efficient when the ski glides evenly, without jerking. This is where efficiency is the greatest, as the energy related to the thrust moves the skier forward. However, this is not always the case. Sometimes, the ski undertakes a short backward travel, or the advance is simply shortened in relation to the maximum possible.

When vertical support is being taken with one leg, the ski is pressed flat on the ground, which makes it possible for the skier to move the other leg forward. The support is stable when the ski, on which the impulse is applied, does not move backward while the other ski is being moved forward. This is where efficiency is increased because the length of the strides tends towards the maximum possible. However, it appears that this is not always the case. Sometimes the ski, biased towards the ground moves backward against the skier's will. This negatively affects the steering efficiency.

Steering efficiency is also negatively affected sometimes when operating snowshoes. As with cross-country skiing involving alternate steps, the length of the stride is reduced in relation to the maximum possible, or a snowshoe in support moves backward against the skier's will.

In downhill skiing, where the boot is retained at the front and back, the skier has to be laterally supported on the running edges in order to manage his/her path. The skier's path is all the more precise as each running edge glides without skidding. A lateral support force must thus be applied as firmly as possible to make it easier for a running edge to penetrate in the snow. Again, it appears not always to be the case. Sometimes, the board, in this case the ski, skids against the skier's will. The loss of energy resulting from undesired skidding negatively affects the steering efficiency.

SUMMARY

In view of the above, the invention in particular improves the steering efficiency of a gliding board. For example, the invention reduces the loss of energy and minimizes, or even eliminates, undesired movements of the board.

In addition, the invention facilitates the handling of the board, i.e., steering control.

Further, the invention reduces the user's fatigue by obtaining the same effect with less effort.

Thus, the invention proposes an assembly including a gliding board and a device for retaining an article of footwear on the board, the device extending longitudinally from rear to front, the board having a zone for receiving the retaining device longitudinally in relation to the board.

The assembly according to the invention includes a wedge mechanism which inclines the retaining device longitudinally in relation to the board, so that the position of the retaining device is angled downwardly from front to rear.

In other words, the front of the retaining device is farther away from the board than the rear. Consequently, when the boot is in flat support on the device, its tip is farther spaced from the board, or from the bottom gliding surface of the board, than its heel. In this configuration, the boot and the board form an open angle facing the front.

When cross-country skiing with skating steps, the ski maintains a position parallel to the ground more easily. This is verified during the exertion of a pushing force as well as during the exertion of a forward return force. Thus, during a push, the support of the ski on the ground is better distributed, in the sense that it occurs over the entire length of the ski. Consequently, the surface in contact with the ground is increased, particularly at the beginning of the lateral push. Thus, the ski skids slightly, or not at all. Efficiency is higher. The ski, during a return, flies over the ground without catching on the ground. Thus, steering is carried out more freely.

When cross-country skiing with alternate steps, the ski glides more evenly during a forward thrust. In vertical support, the ski moves backward very slightly, or even not at all. Due to the invention, the support is more intense. The steering efficiency is better.

The same advantages are found in snowshoeing.

With respect to downhill skiing, edge setting is sharper and more intense, especially towards the front of the ski. This makes it possible to set the skis in curves while avoiding undesired skidding. Steering is therefore easier.

Therefore, for a number of types of skiing, steering efficiency is increased. The loss of energy is reduced. Undesired movements of the board are exceptional. Steering control is improved. Moreover, the user becomes less tired.

BRIEF DESCRIPTION OF DRAWINGS

Other characteristics and advantages of the invention will be better understood from the description that follows, with reference to the annexed drawings illustrating, by way of non-limiting embodiments, how the invention can be made, and in which:

FIG. 10 is a cross section along the line X-X of FIG. 9;

FIG. 11 is a cross section similar to that according to FIG. 10, for an eighth embodiment of the invention.

DETAILED DESCRIPTION

Although the embodiments described hereinafter relate to an assembly for cross-country skiing, it is to be understood that they also apply to assemblies used in other fields as mentioned above.

Figure 1:
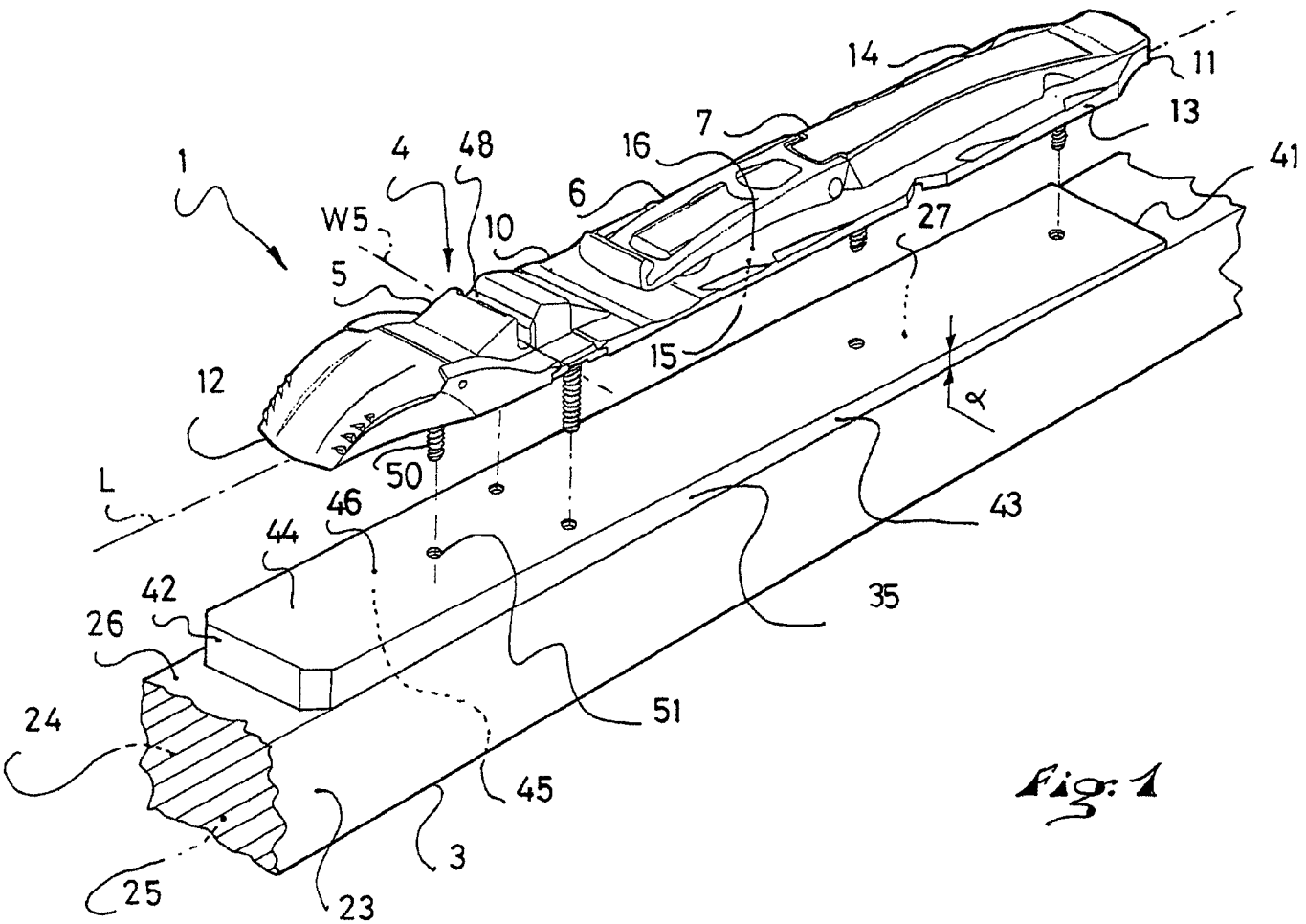
FIG. 1 is an exploded, perspective view of an assembly according to a first embodiment of the invention.
Figure 2:
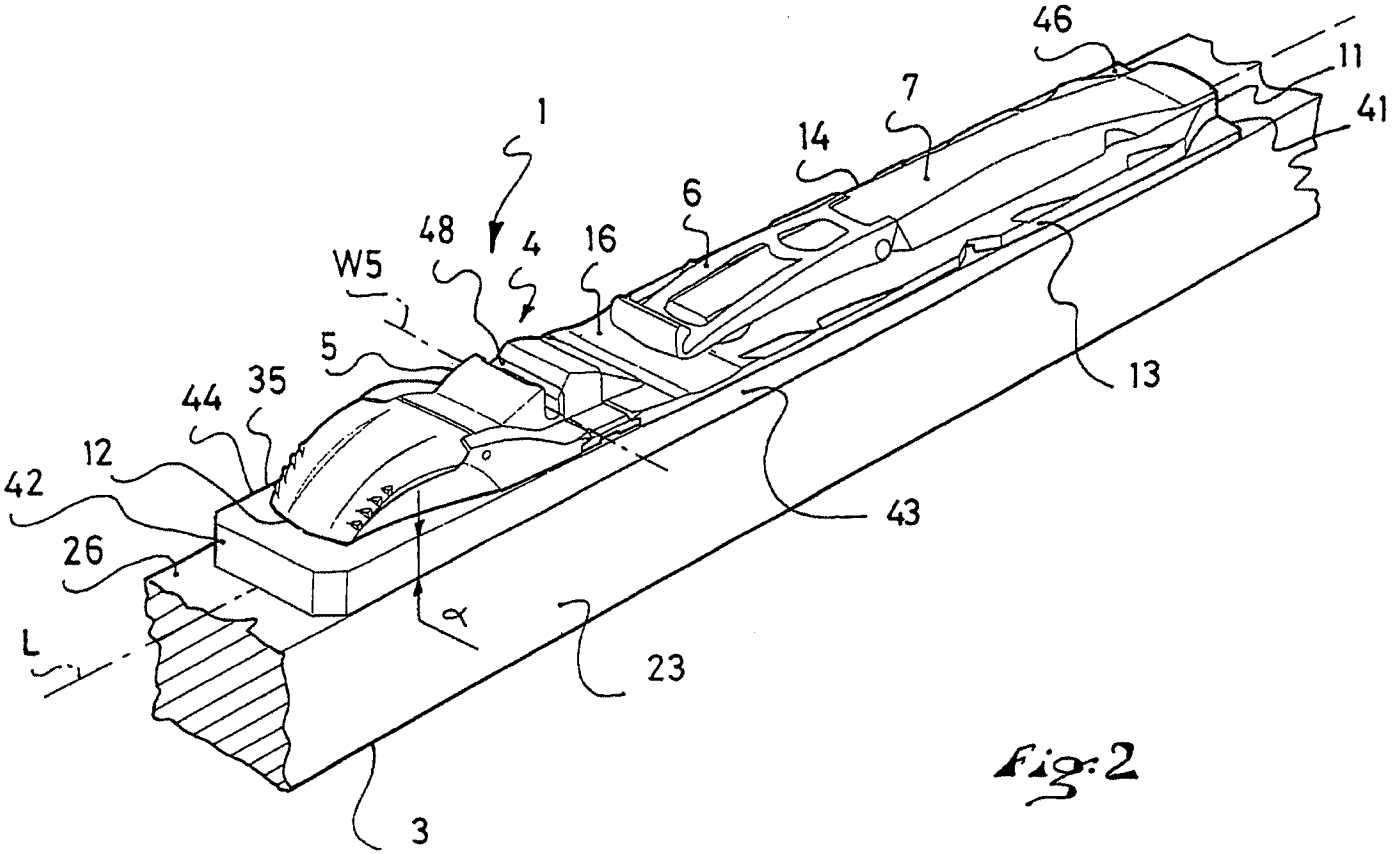
FIG. 2 is similar to FIG. 1, in a case in which the components of the assembly are affixed to one another.

The first embodiment is shown using FIGS. 1 and 2.

As can be understood from FIG. 1, an assembly 1 enables a boot (not shown) to be retained on a gliding board 3 by means of a removable retaining device 4. The board 3, shown only partially, is a cross-country ski adapted for cross-country skiing. This involves steering the ski 3 with movements that include an alternate lifting of the heel. Such a binding, for which the heel of the boot is alternately upwardly movable, is used in sports such as those mentioned above, including the so-called free-heel binding used in cross-country and telemark skiing, for example The boot retaining device 4 is well known to one with ordinary skill in the art. According to the illustrated embodiment, and in a non-limiting fashion, the device 4 includes a reversible locking mechanism 5 and an elastic return mechanism 6 for connection to the front of the boot. A guiding rib 7 is provided, in this case a single rib extending rearwardly of the locking mechanism and the elastic return mechanism, the rib enabling the boot to be retained transversely. This is especially true when the heel, which is allowed to be raised and lowered in relation to the ski, is pressed flat on the rib. Alternatively, a plurality of guiding ribs can be used.)

The retaining device 4 further includes a base plate 10 which carries the locking mechanism 5, the return mechanism 6, and the rib 7. A mechanism 5, 6, the edge 7, or even all of the components 5, 6, 7, are attached and affixed by any means to the base plate 10.

The base plate 10 extends lengthwise, along a longitudinal direction L, between a first end 11, or rear end, and a second end 12, or front end.

The base plate 10 extends transversely between a first edge 13 and a second edge 14, and height-wise from a support surface 15 to a receiving surface 16. In other words, the retaining device 4 extends along the longitudinal direction L, between the first end 11 and the second end 12, widthwise between the first edge 13 and the second edge 14, and height-wise between the support 15 and receiving 16 surfaces. The support surface 15 faces the ski 3, whereas the receiving surface 16 is provided to receive the boot.

The longitudinal direction L of the retaining device 4 merges with that of the ski, as will be understood better below, when the device 4 is affixed to the ski. Consequently the guiding rib 7 is directed along the length of the ski, as well as the boot.

Furthermore, it is noted that only one retaining device 4 is affixed to ski 3. In other words, only one boot is retained on the ski 3.

The ski 3, from a geometrical point of view, extends transversely between a first edge 23 and a second edge 24, and height-wise from a support surface 25, i.e., gliding surface or sole, to a receiving surface 26. The support surface 25 is adapted to contact the snow, and the receiving surface 26 is provided to support the retaining device 4 in the area of a receiving zone 27. In a known manner, the receiving zone 27 is located between the ends (not shown) of the ski, for example towards the middle or slightly away from the middle.

The width of the base plate 10, measured between the edges 13, 14, is substantially equal to that of the ski 3, which is measured between the edges 23, 24. The width can alternatively be different, for example slightly greater, or slightly smaller, the variation being of a few millimeters. In general, the width of a base plate adapted for cross-country skiing ranges between 30 and 50 mm.

According to the invention, the assembly 1 includes a wedge device that inclines the retaining device 4 longitudinally in relation to the ski 3, so that the position of the retaining device is angled downward from the front end 12 to the rear end 11, including in a heel area.

In other words, the wedge device carries the retaining device 4 along a downward slope, from the front end 12 to the rear end 11. It could also be said that the slope is upward from the rear end 11 to the front end 12. As a result, the reversible locking mechanism 5 is farther apart, in relation to the receiving surface 26 of the ski 3, than the rear end 11, but also than the guiding rib 7 and the return mechanism 6. Thus, when the boot is flat on the retaining device 4, its tip is raised in relation to its heel.

This makes it possible, when practicing skating steps, to bring back the ski forward by keeping it parallel to the snow. Indeed, in this case, the foot is in extension in relation to the leg, because it has just exerted a thrusting/pushing force. The fact that the front of the boot is raised makes it possible to lower the front of the ski, during the forward return. As a consequence, the rear of the ski rises; and the ski remains parallel to the ground.

This arrangement also makes it possible to exert more uniform thrusting forces towards the ground, while still performing skating steps. This is due to the action of the leg, which is transmitted towards the tip of the boot during the extension of the foot. The action is the strongest at the end of the thrust, for the maximum extension. At that moment, the raising of the front of the device 4 amplifies the transmission of the steering impulse towards the front of the ski. Advantageously, there results a more intense contact with the ground. Consequently, the ski skids only slightly or not at all during the thrust.

When using alternative steps, the vertical impulse, which makes it possible to take support on a ski, is also amplified due to the difference in height between the tip and the heel of the boot. This difference in height also improves the longitudinal guiding during a forward impulse. The ski glides with more progressiveness, and without jerking at the end of the travel. This is the reason why the energy necessary for moving the skier forward is greater.

According to the first embodiment, and in a non-limiting fashion, the wedge device includes a wedge-shaped shim 35. This shim 35 is located between the ski 3 and the retaining device 4. The shim 35 extends longitudinally from a first end, or rear end 41, to a second end, or front end 42; transversely between a first edge 43 and a second edge 44; and height-wise from a support surface 45 to a receiving surface 46. The support surface 45 is provided to face the ski 3, more precisely here in contact with the receiving surface 26. The shim 35 is therefore in direct contact with the ski 3. However, an indirect contact can alternatively be provided. In this case, one or more additional elements are inserted between the ski and the shim.

Accordingly, as can be understood from FIGS. 1 and 2, the receiving surface 46 of the shim 35, or wedge device, directly supports the retaining device 4 and rigidly supports the retaining device 4 against movement toward the ski 3. Here again, an indirect contact can alternatively be provided, with one or more elements located between the shim and the device.

An advantage related to the first embodiment, i.e., with a single shim 35, exclusive of additional layers, is a more direct transmission of the steering impulses and sensory information between the ski 3 and the retaining device 4. Consequently, the steering is better controlled.

According to the first embodiment described, the wedge-shaped shim 35 is a unitary element. This means that it extends continuously between its ends 41, 42, its edges 43, 44 and its support 45 and receiving 46 surfaces. Accordingly, at least thickness-wise, or height-wise, the shim is made of a single continuous material or a single continuous structure. The shim 35 can alternatively include a plurality of distinct sections, which are elements separate from one another. In this case, the sections are arranged between the ski 3 and the device 4 to form the shim. The sections are joined, or spaced apart.

The shim 35 includes a plastic material, for example, and is manufactured using any technique such as molding, machining, or the like.

According to the illustrated embodiment, the shim 35 has a solid structure. This makes its manufacture simple and economical. The shim 35 can also be provided to have cavities in order to form a perforated element. In this case, the cavities are open, and they open out either on the side of the support surface 45, or on the side of the receiving surface 46. The cavities can also extend through the shim 35, for example height-wise, which lightens the shim.

Another alternative involves structuring the shim 35 so as to include transverse notches. These notches extend, for example, from the receiving surface 46 to the support surface 45, without however opening out in the area of the support surface. In fact, each transverse notch opening out on the side of the receiving surface 46 is in the area of the edges 43, 44. This enables the shim 35 to deform flexionally along a transverse axis, that is, the shim otherwise being rigid. Thus, the shim 35 is applied even more easily against the ski 3, in the sense that it adapts better to a possible curvature of the receiving surface 26.

The shim 35 is dimensioned to support the entire retaining device 4. Thus, the shim 35 can have a length equal to or greater than that of the device 4. For example, the shim 35 has a length greater than or equal to 27 centimeters, for a retaining device intended for children. The shim 35 has a length greater than or equal to 31 centimeters, for a retaining device intended for adults.

The width of the shim 35, measured between the edges 43, 44, is substantially equal to that of the ski 3 or of the retaining device 4. The width can also be different, for example slightly greater, or slightly smaller, the variation being of a few millimeters. In general, the width of a shim for the cross-country ski ranges between 30 and 60 mm. One can also say that the width of the shim ranges between 80% and 120% of the width of the ski and, in a particular embodiment, between 85% and 100%.

The height of the shim 35, measured between the support 45 and receiving 46 surfaces, varies longitudinally. The height, or thickness, varies so as to increase from the rear end 41 to the front end 42. The height therefore decreases from the front end 42 to the rear end 41.

According to the first embodiment, and in a non-limiting fashion, the variation in height is even, i.e., continuous. In fact, the support surface 45 is planar and the receiving surface 46 is also planar. This inclines the retaining device 4 longitudinally in relation to the ski 3, so that the device is oriented downwardly from its front end 12 to its rear end 11. Consequently, the tip of the boot is higher on the ski than the heel. This arrangement makes it possible to provide stronger vertical impulses with the front of the foot. This means impulses directed downward to press the ski flat on the ground. Given that the impulses are stronger at the heel, the presence of the shim 35 in fact compensates for the excess observed at the heel, in order to distribute the supports provided by the leg under the entire boot. Consequently, the pressures exerted by the user on the ski, in particular toward the front, are better controlled. This results in support forces that are better distributed over the length of the ski, and thus in gliding movements with no undesired skidding when using skating steps. The movements returning the ski are also better controlled—they occur without interference with the ground, because the ski remains more easily parallel to the ground. Therefore, it only requires a minimal lift to move it, which reduces the effort required.

The slope provided by the shim 35 ranges between 0.2 and 5.0 degrees, according to the first embodiment of the invention. The slope must be understood as the angle $\alpha$ formed between the support 45 and receiving 46 surfaces. Consequently, the shim 35 inclines the retaining device 4 by a value of angle $\alpha$, ranging between 0.2 and 5 degrees, in relation to the ski 3.

In practice, the shim 35 has a thickness close to 1.0 mm towards the heel of the boot, i.e., towards the rear end 41. The shim 35 has a thickness of about 5.0 mm towards the front end 42. In this case, the slope is between 0.55 and 0.85 degrees, depending upon the boot sizes, i.e., also depending upon the selected shim length.

It is also possible to measure the thickness of the shim 35 in the area of a transverse axis W5 of the locking mechanism 5. This axis W5 is perpendicular to the longitudinal direction L, and parallel to the support surface 15 of the base plate 10. The axis W5 is the center of a jaw 48 of the locking mechanism 5, the jaw being provided to removably retain an anchoring element (not shown) of the boot. This element can be a metallic rod.

The transverse axis W5 is in the vicinity of and slightly set back from the front end 12 of the base plate 10. Consequently, when the base plate 10 is affixed to the shim 35, the transverse axis W5 is in the vicinity of and slightly set back in relation to the front end 42 of the shim 35. The shim 35 can be provided to have a thickness close to 1.0 mm towards the heel of the boot, and about 5 mm towards the transverse axis W5.

One can alternatively provide a thickness close to 1.0 mm towards the rear, and 10 mm towards the front. The slope then ranges between 1.6 and 1.9 degrees. One can also provide a thickness of 1.0 mm towards the rear 41, and 15 mm towards the front 42. The slope then ranges between 2.55 and 2.85 degrees.

For these two cases, the shim 35 can be provided to have a thickness close to 1.0 mm towards the heel of the boot, and about 10 mm or 15 mm towards the transverse axis W5.

Generally speaking, it appears advantageous for the shim 35 to have a slope ranging between 0.2 and 5.0 degrees. A value of angle $\alpha$ ranging between 1.5 and 5.0 degrees is well-suited for practicing with skating steps. A value of angle $\alpha$ ranging between 0.2 and 2.0 degrees is well-suited for practicing alternating steps.

The elements of the assembly 1 are affixed by any means. In a known manner, retaining screws 50 are provided to retain the device 4 on the ski 3, i.e., the screws retain the device 4 against vertical movement in relation to the ski. These screws, for example five in number, extend through the base plate 10, i.e., they extend through through-holes in the base plate, in order to be screwed into the ski. The screw heads are masked by covers for aesthetic reasons, as is well-known to one with ordinary skill in the art. Therefore, this has not been described in detailed here.

According to the invention, openings 51 extend lengthwise through the shim 35, i.e., the openings 51 are through-holes extending through the entirety of a thickness of the shim. There are five of these openings, positioned opposite screws 50. Therefore, the screws 50 retain the device 4 and the shim 35 simultaneously on the ski 3. Any other embodiment can be provided. For example, the shim 35 can be adhered or welded to the ski 3. The screws 50 can then come and engage the shim, or the shim and the ski. In fact, this is dependent upon the thickness of the shim.

Other embodiments of the invention are shown with reference to FIGS. 3 to 11. For reasons of convenience, the elements that are common with the first embodiment are designated by the same reference numerals.

Figure 3:
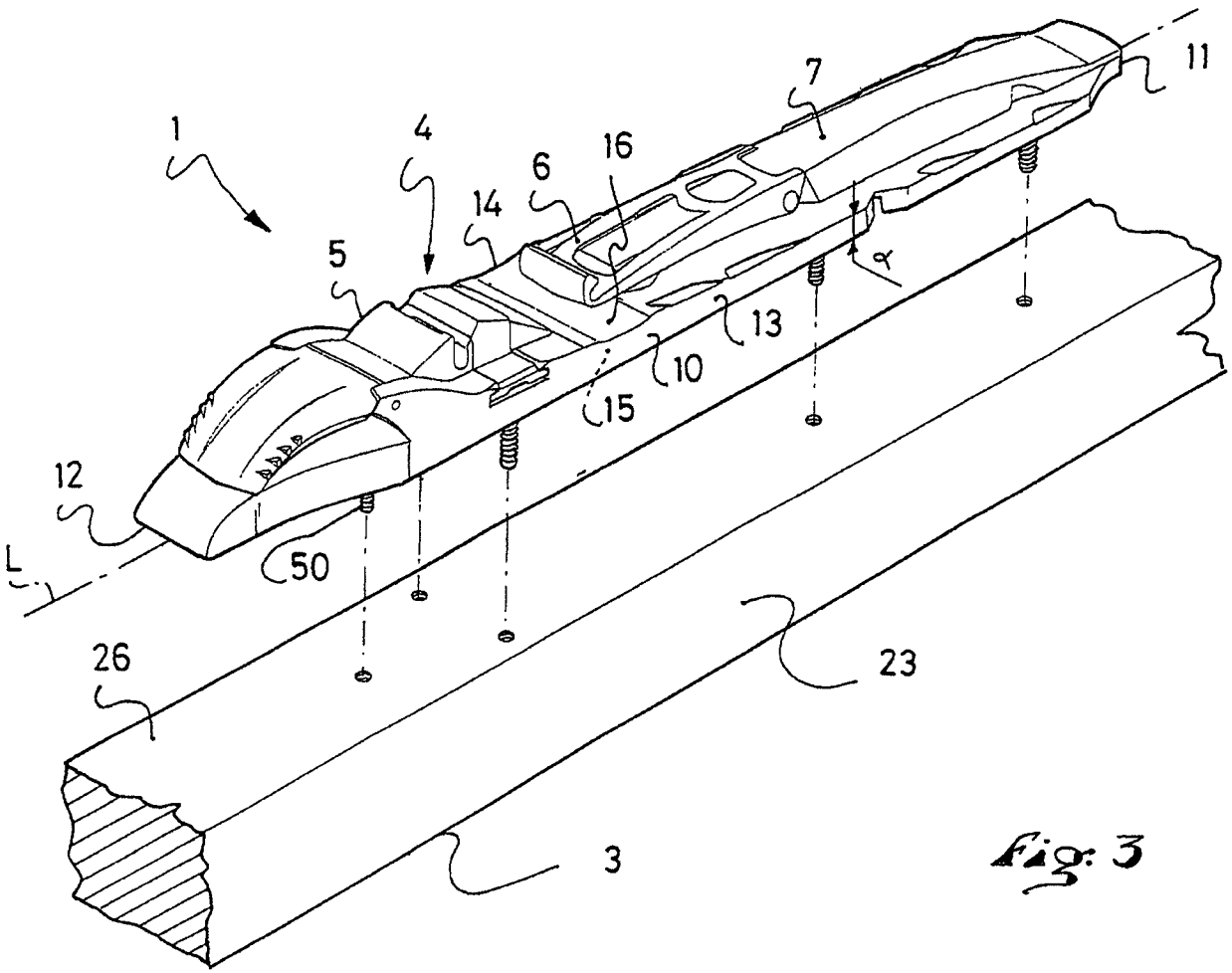
FIG. 3 is an exploded, perspective view of an assembly according to a second embodiment of the invention.

Thus, the second embodiment, according to FIG. 3, has a ski 3 and a retaining device 4, with a base plate 10 that carries a locking mechanism 5, a return mechanism 6, and a guiding rib 7. What is specific to the second embodiment lies in the wedge device. The latter includes the base plate 10, structured to incline the retaining device 4. Thus, the base plate 10 has a thickness, or height, that is variable longitudinally. The base plate 10 thereby constitutes the wedge-shaped shim of this embodiment and, like the first embodiment, includes screws 50 extending through through-holes in the base plate to fasten the base plate to the ski. The base plate 10 becomes thicker in a direction extending from its rear end 11 to its front end 12. Thus, the angle a that defines the slope can be measured using the support 15 and receiving 16 surfaces of the base plate 10.

According to the embodiment shown, the thickness of the base plate varies evenly and continuously. An uneven variation can also be provided.

The base plate 10 rests directly on the ski 3. The assembly 1 is thus formed with a reduced number of elements. This lowers the manufacturing costs and simplifies the assembly.

Figure 4:
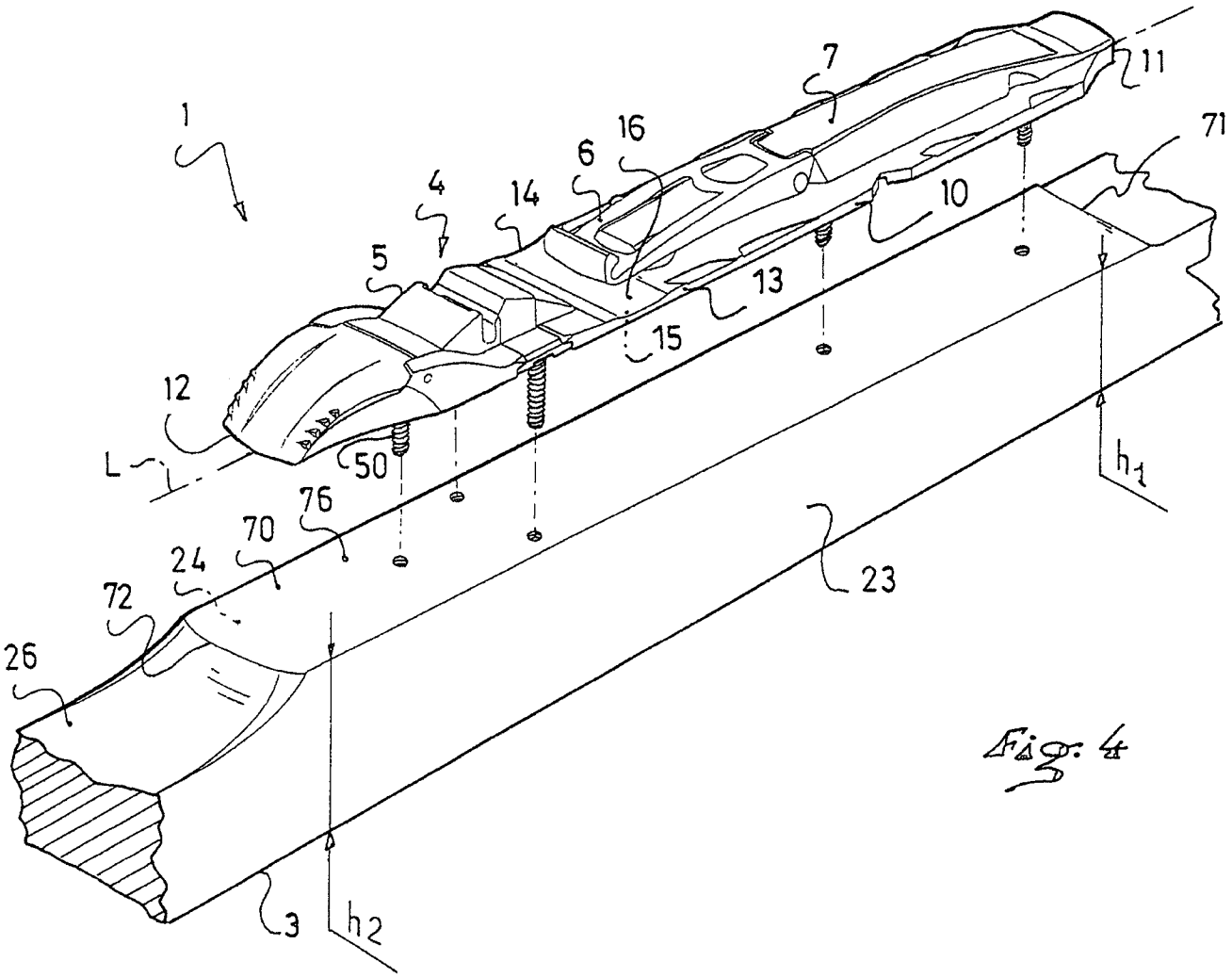
FIG. 4 is an exploded, perspective view of an assembly according to a third embodiment of the invention.

The third embodiment of the invention, according to FIG. 4, also has a ski 3 and a retaining device 4, with a base plate 10 which carries a locking mechanism 5, a return mechanism 6, and a guide rib 7.

The wedge device includes a raised portion 70 which projects in relation to the receiving surface 26. This raised portion is adapted to receive the retaining device. Thus, the raised portion 70 extends longitudinally from a rear limit 71 to a front limit 72, and transversely from the first edge 23 to the second edge 24. Between the limits 71, 72 and the edges 23, 24, the raised portion has a receiving surface 76 adapted to carry the device 4.

According to the third embodiment, the receiving surface 76 is planar/flat and is inclined longitudinally so that the retaining device 4 is reduced, i.e., angled downwardly, thereby creating a wedge device, or a wedge-shaped device, from the front end 12 to the rear end 11. Specifically, the thickness of the ski, or its height, varies decreasingly from the front limit 72 to the rear limit 71 of the raised portion 70. In other words, the height h1 of the ski 3, measured at the rear limit 71, is smaller than the height h2 of the ski 3, measured at the front limit 72.

Figure 5:
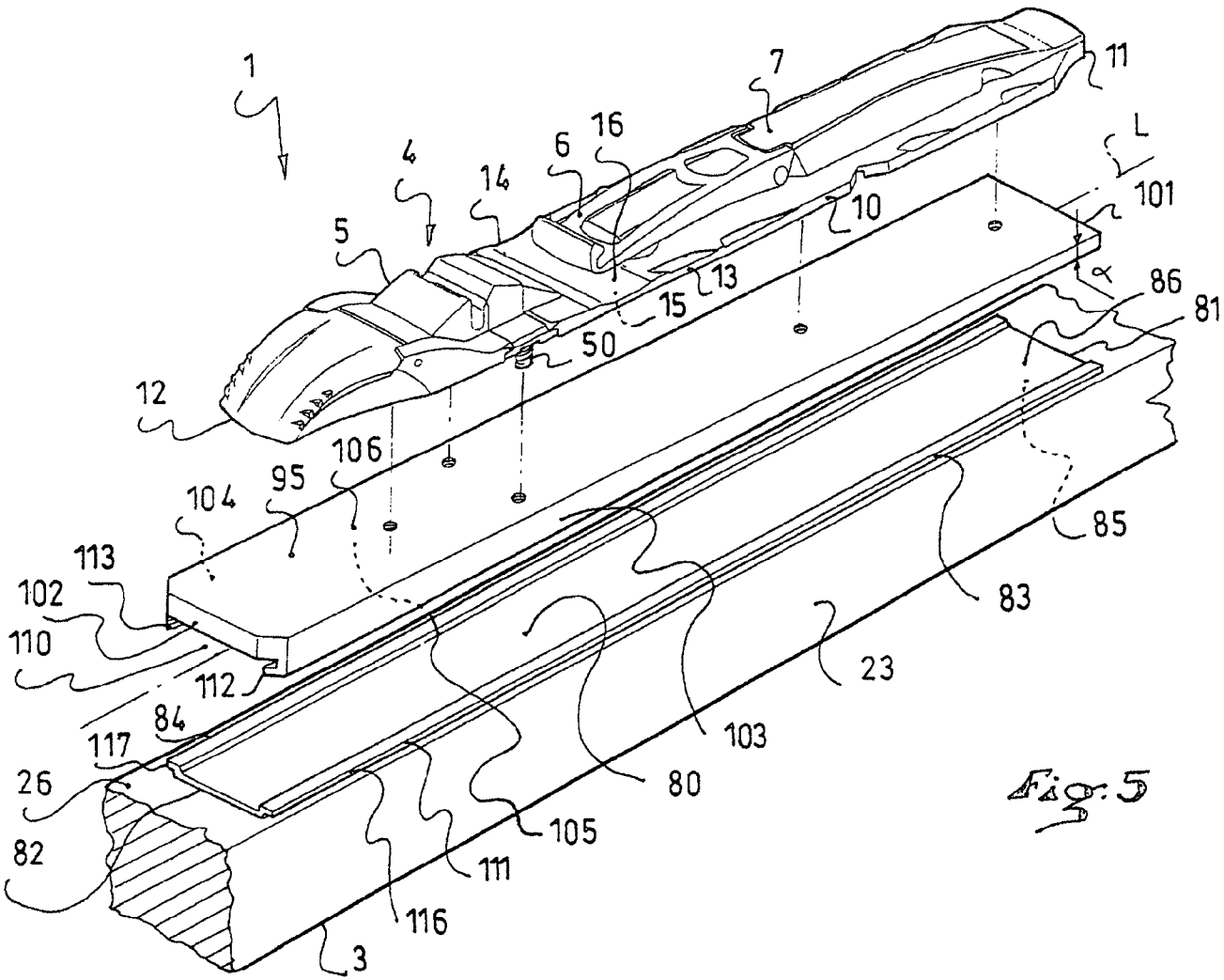
FIG. 5 is an exploded, perspective view of an assembly according to a fourth embodiment of the invention.

The fourth embodiment of the invention, according to FIG. 5, also calls for a ski 3 and a retaining device 4, with a base plate 10 which carries a locking mechanism 5, a return mechanism 6, and a guide rib 7.

A specific characteristic of the fourth embodiment is the affixing of the retaining device 4 to the ski 3. In this regard, the assembly 1 includes a base 80 provided to be associated with the ski 3. Similar to the base plate 10, the base 80 extends lengthwise along the longitudinal direction L, between a first end 81, or rear end, and a second end 82, or front end. The base 80 extends transversely between a first edge 83 and a second edge 84, and height-wise from a support surface 85 to a receiving surface 86. The support surface 85 is provided to be affixed to the ski 3, whereas the receiving surface 86 is provided to carry the base plate 10.

A non-removable affixing means, such as an adhesive or welding, is provided for associating the base 80 with the ski 3. Also, the base 80 could form a unitary element with the ski 3. However, a removable affixing means, such as screws, nesting, or any equivalent, could alternatively be provided.

The wedge device, which inclines the retaining device 4 in relation to the board, includes a shim 95 that is configured to be associated with the base 80. The shim 95 extends lengthwise, along the longitudinal direction L, between a first end 101, or rear end, and a second end 102, or front end. The shim 95 extends transversely between a first edge 103 and a second edge 104, and height-wise from a support surface 105 to a receiving surface 106. The support surface 105 is provided to be affixed to the base 80, whereas the receiving surface 106 is provided to receive the base plate 10. A removable affixing device is provided to associate the shim 95 with the base 80. This affixing device includes, according to the fourth embodiment, a mechanism for longitudinally guiding the shim 95 in relation to the base 80. The guiding mechanism itself includes a slide 110 arranged on the shim 95, as well as a rail 111 arranged on the base 80. The rail 111 is structured to cooperate with the slide 110, thereby providing a longitudinal adjustment mechanism to longitudinally adjust a position of the shim with respect to the base, i.e., with respect to the board.

In a non-limiting fashion, the slide 110 is transversely demarcated by two edges 112, 113 turned towards one another. Consequently, the rail 111 is transversely demarcated by two wings 116, 117 opposite one another.

An inverse arrangement could be provided. A slide could be arranged on the base 80, and a rail arranged on the shim 95.

The assembly 1 is assembled by nesting the shim 95 on the base 80 along the longitudinal direction L, then by screwing the screws 50 through the base plate 10 and the shim 95. The screws 50 retain the retaining device 4 on the shim 95 and take support on the base 80. This longitudinally immobilizes the device 4, which is also in an adjustable position. Also, like in previously described embodiments, the screws retain the device 4 against vertical movement in relation to the ski.

Any other means can be provided for adjusting the longitudinal position of the device 4 and/or of the shim 95.

The shim 95 inclines the retaining device 4. Thus, the shim 95 has a thickness, or height, that is variable longitudinally. The thickness of the shim 95 increases from its rear end 101 to its front end 102. Thus, the angle α which defines the slope can be measured using the support 105 and receiving 106 surfaces of the shim 95.

An inverse or complementary arrangement can be provided. In this case, the base 80 has a height which increases from its rear end 81 to its front end 82.

Figure 6:
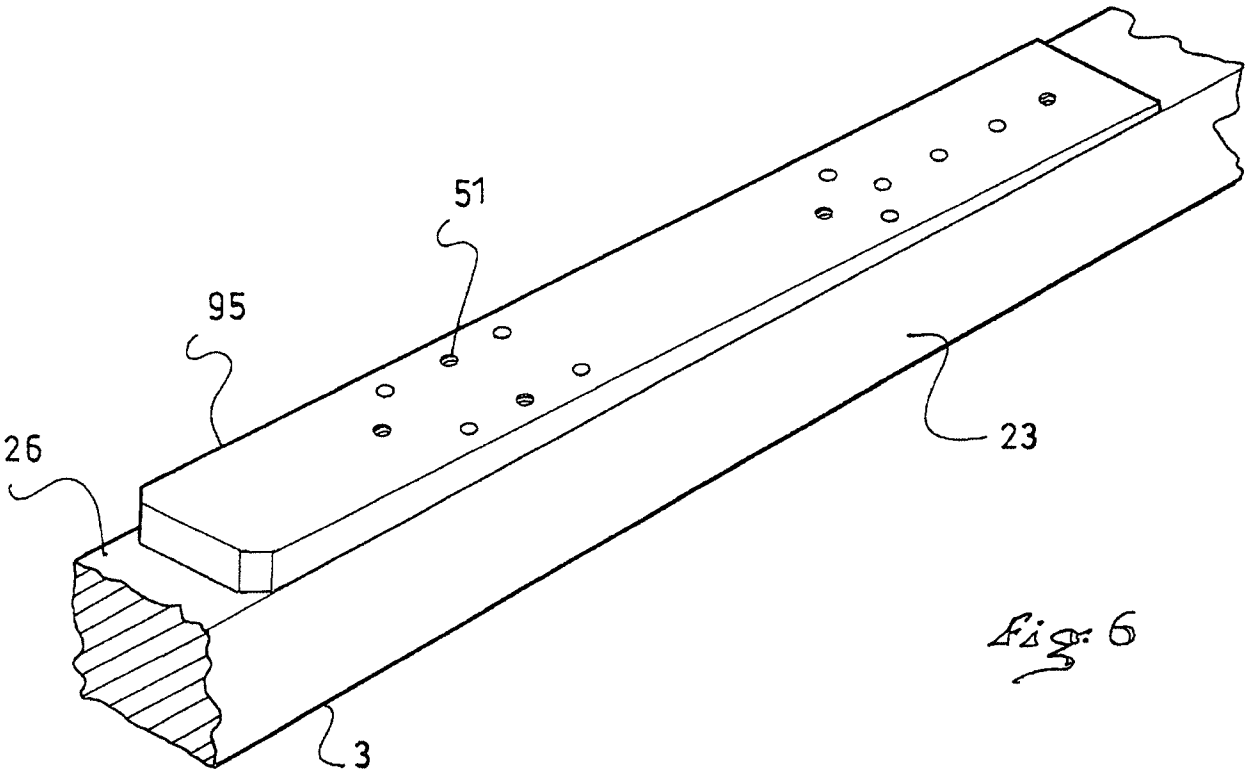
FIG. 6 is a partial perspective view of an assembly according to a fifth embodiment of the invention.

The fifth embodiment of the invention, according to FIG. 6, shows that a shim 95 can have a plurality of openings 51. These openings are arranged in correlation with various retaining devices, for which the distribution of screws are specific. The number of openings 51 of the shim 95 is greater than the number of retaining screws 50 for securing the retaining device 4.

Figure 7:
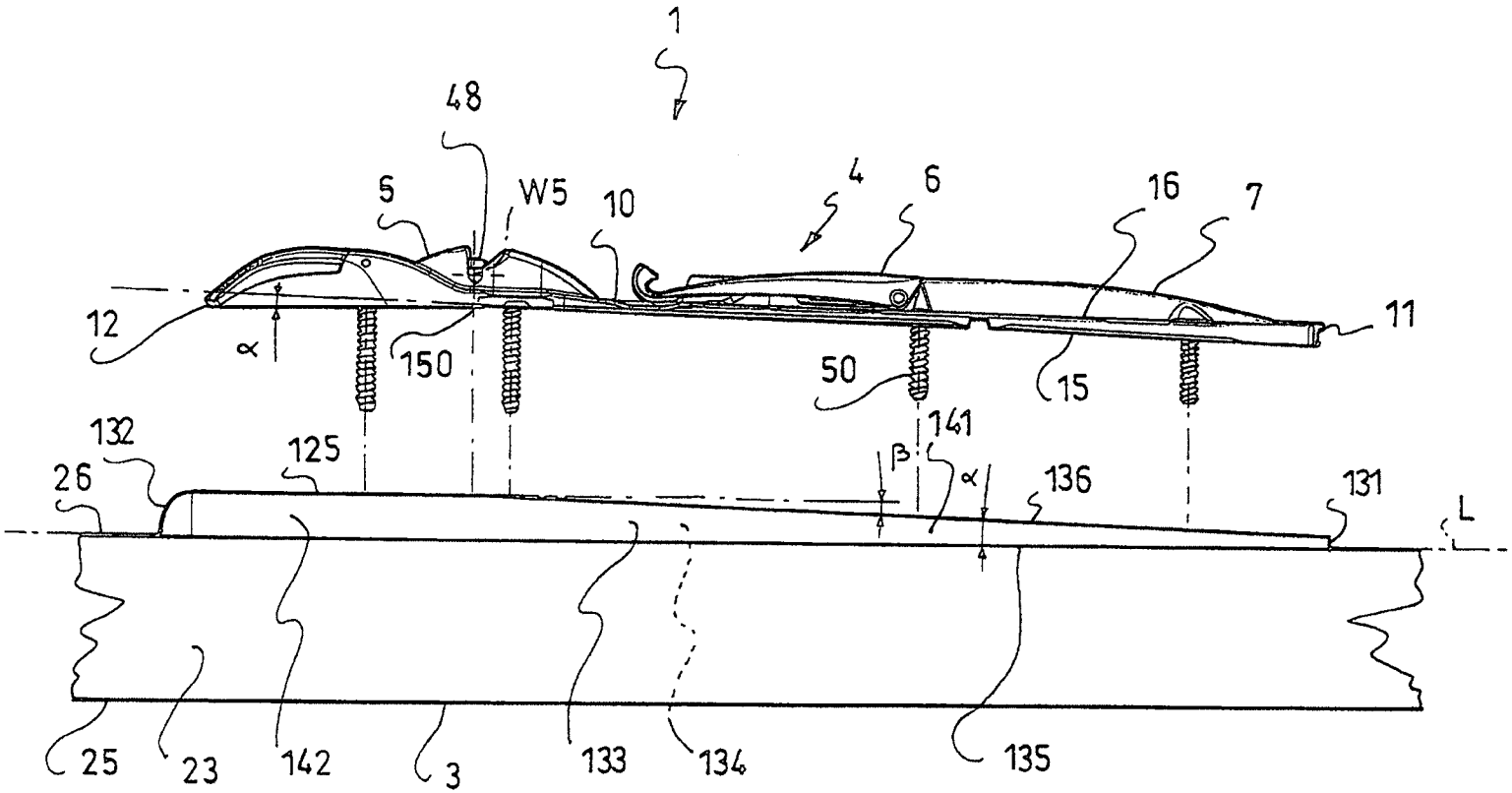
FIG. 7 is an exploded side view according to a sixth embodiment of the invention.

The sixth embodiment of the invention, according to FIG. 7, also includes a ski 3 and a retaining device 4, with a base plate 10 which carries a locking mechanism 5, a return mechanism 6, and a guiding rib 7. The locking mechanism 5 includes a jaw 48 having a transverse axis W5.

What is specific to the sixth embodiment lies in the wedge device. The latter includes a shim 125, which extends longitudinally from a rear end 131 to a front end 132, transversely between a first lateral edge 133 and a second lateral edge 134, and height-wise, or depth-wise, between a support surface 135 and a receiving surface 136.

According to the sixth embodiment, the shim 125 includes a plurality of sections with different slopes.

For example, in a non-limiting fashion, the shim 125 includes a first section 141, or rear section, as well as a second section 142, or front section. The first section 141 extends from the rear end 131 to the front end 132, whereas the second section 142 extends from the front end 132 to the rear end 131. The rear 141 and front 142 sections join one another in the area of the jaw 48, or of the transverse axis W5, of the locking mechanism.

The rear section has a slope measured at the angle α, as described above. The slope increases from the rear 131 forward. The slope changes starting from the axis W5, and it is reduced here. The slope variation is measured by the angle β, which is obtained at the intersection of the two following planes: the receiving surface 136 in the area of the rear section 141, and the imaginary extension of the receiving surface 136 extending from the front section 142. Here the angles α and β are equal. In other words, the support 135 and receiving 136 surfaces are parallel in the area of the front section. This might not be the case. The angle β could be greater than the angle α. In such a case, the junction of the sections 141, 142 in the area of the axis W5, is a vertex.

The base plate 10 is configured to closely assume the shape of the shim 125. Consequently, the support surface 15 of the base plate 10 forms a dihedron, the vertex 150 of which is in the area of the transverse axis W5. An advantage related to this embodiment is to increase the forward tilting amplitude of the boot. Indeed, the latter pivots alternatively about the axis W5. The change in the slope reduces the height of the front end 12 of the base plate 10. This lowers the front of the locking mechanism 5. Consequently, the skier has more freedom of movement, and the steering of the ski is easier.

Figure 8:
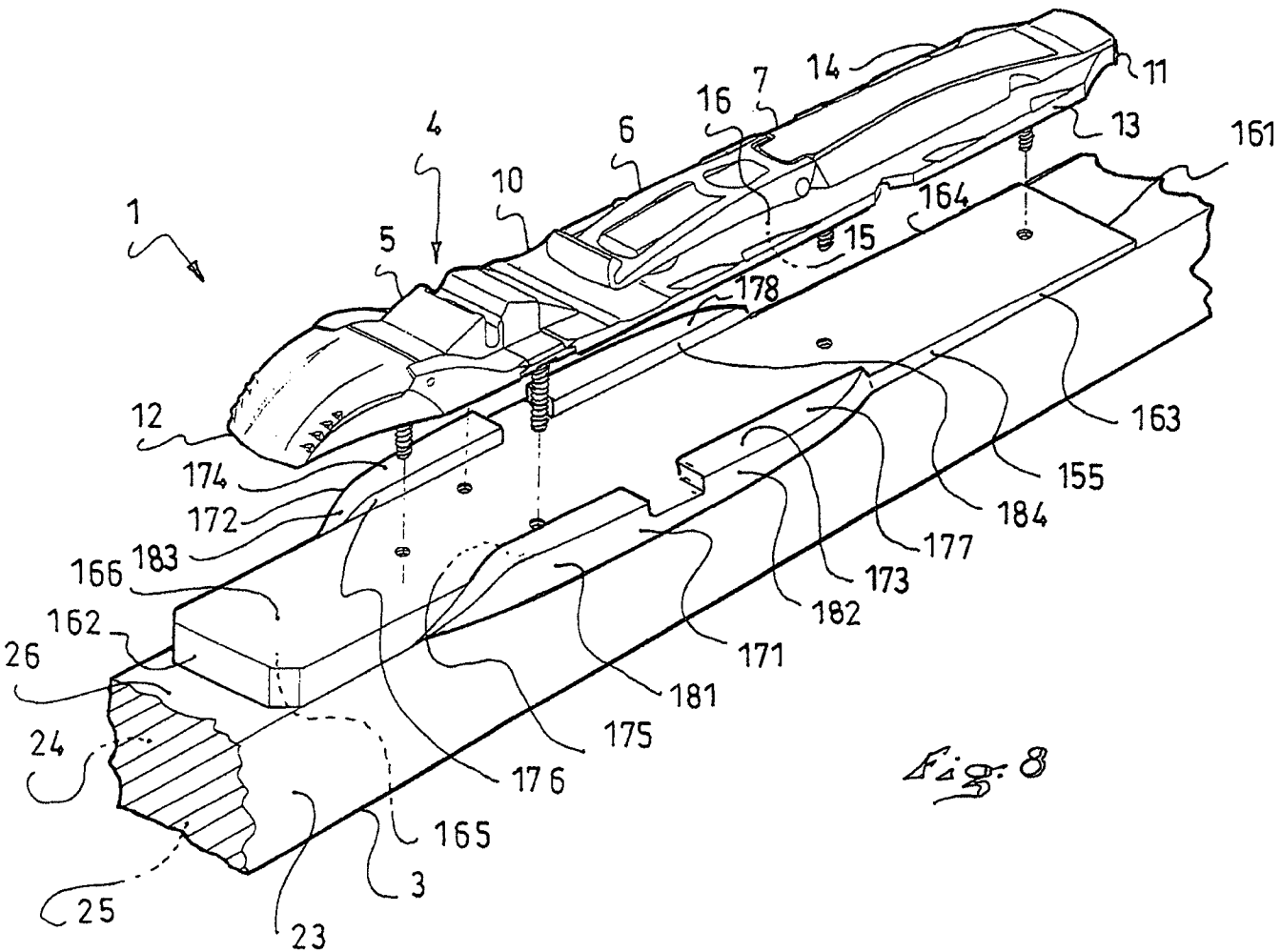
FIG. 8 is an exploded, perspective view of an assembly according to a seventh embodiment of the invention.
Figure 9:
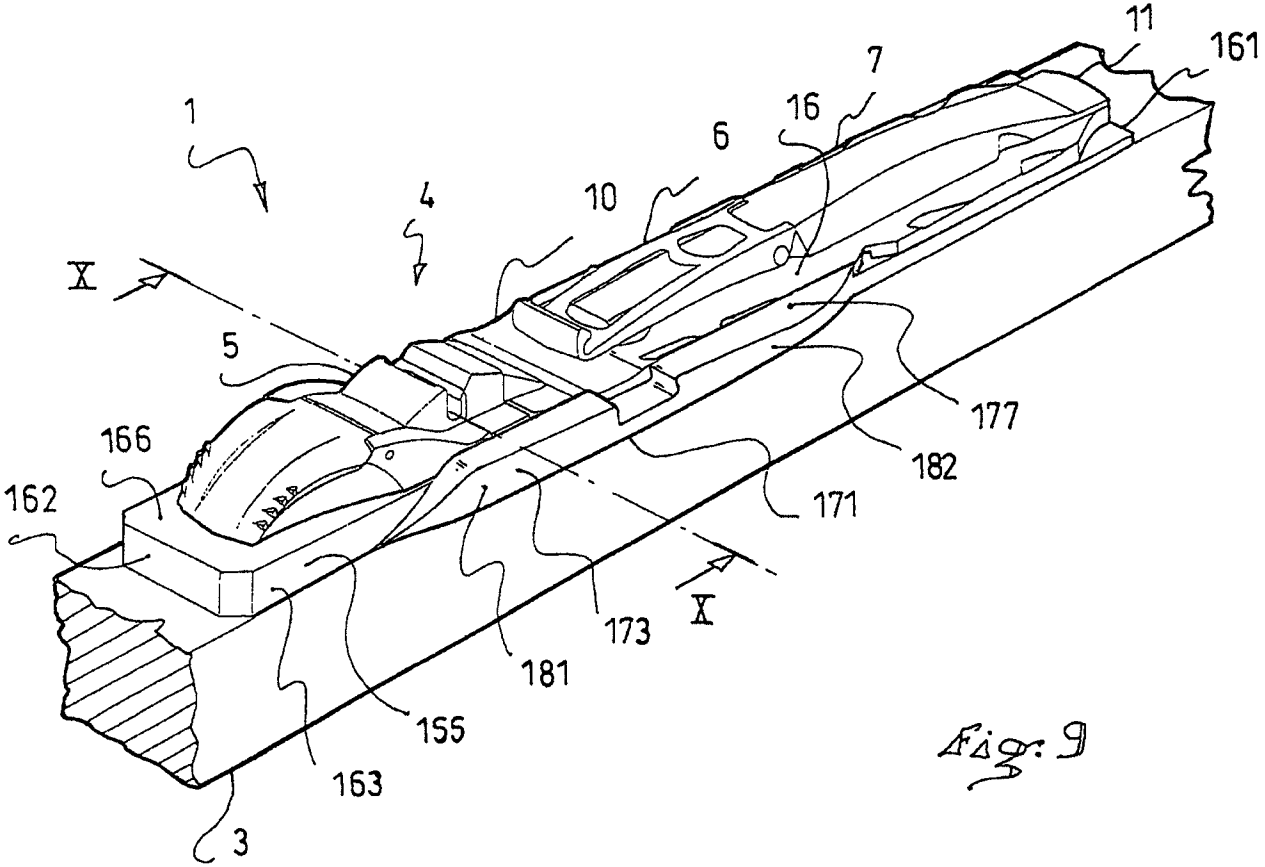
FIG. 9 is similar to FIG. 8, in a case in which the components of the assembly are affixed to one another.

The seventh embodiment of the invention, according to FIGS. 8 to 10, has a ski 3 and a retaining device 4, with a base plate 10 which carries a locking mechanism 5, a return mechanism 6, and a guide rib 7. The locking mechanism 5 includes a jaw 48 having a transverse axis w5.

What is specific to the seventh embodiment lies in the wedge device. The latter includes a shim 155, which extends longitudinally from a rear end 161 to a front end 162, transversely between a first lateral edge 163 and a second lateral edge 164, and height-wise, or depth-wise, between a support surface 165 and a receiving surface 166.

The shim 155 includes at least one lateral flange 171, 172. Each flange widens the shim 155 locally in order to transversely extend the support provided to a boot retained on the assembly 1. A broader transverse support improves the stability of the foot during steering.

According to the seventh embodiment, in a non-limiting fashion, the shim 155 includes a first lateral flange 171, on the side of the first edge 163, as well as a second lateral flange 172, on the side of the second edge 164. This increases the transverse support on both sides of the boot.

At least one flange 171, 172 has an upper ridge 173, 174 raised in relation to the receiving surface 166 of the shim 155. More precisely, the first flange 171 has a first upper ridge 173, and the second flange 172 has a second upper ridge 174. Consequently, each ridge 173, 174, and therefore each flange 171, 172, has an inner edge 175, 176, respectively, provided to be opposite a lateral edge 13, 14 of the base plate 10. This enables the base plate 10 to be mounted between the flanges 171, 172.

In a particular embodiment, although not required by the invention, the tops 177, 178 of the ridges 173, 174, respectively, extend in the area of the receiving surface 16. For example, each top is parallel to the receiving surface 16. This brings continuity in the support provided to the boot.

In order to lighten the shim 155, and also to provide it with a shape that is more complementary to that of the base plate, at least one flange 171, 172 has subdivisions 181, 182, 183, 184 which give it a discontinuous appearance. More precisely, the first flange 171 has first 181 and second 182 subdivisions. Similarly, the second flange 172 has a first 183 and second 184 subdivisions.

Consequently, the upper ridges 173, 174 and the inner edges 175, 176 of the flanges are discontinuous. This does not hinder their function. One can even provide to increase the subdivisions of the flanges.

According to the seventh embodiment of the invention, the flanges 171, 172 are transversely symmetrical. Consequently, the inner edges 175, 176 are opposite one another. This promotes the management of the transverse support forces.

The eighth embodiment of the invention is shown with reference to FIG. 11. This embodiment is identical or similar to the preceding embodiment, except for one detail, which is described hereinafter.

In fact, according to the eighth embodiment, at least one flange 171, 172 has a lower ridge 193, 194 projecting in relation to the support surface 165 of the shim 155. More precisely, the first flange 171 has a first lower ridge 193, and the second flange 172 has a second lower ridge 194. Consequently, each ridge 193, 194, has an inner edge 195, 196, respectively, provided to be opposite a lateral edge 23, 24 of the ski 3. This increases the mechanical strength of the flanges. Each inner edge 195, 196 of a flange can be provided to take support on a lateral edge 23, 24 of the ski. This reduces, even eliminates, a transverse flexion of a flange during support forces related to steering. A resulting advantage is more precise support and, naturally, a more precise steering.

Here again, a flange can be continuous or discontinuous and, consequently, a lower ridge 193, 194 can be continuous or discontinuous.

Generally, the invention is embodied from materials and according to implementation techniques known to the one with ordinary skill in the art.

The invention is not limited to the specific embodiments described hereinabove, and includes all of the technical equivalents that fall within the scope of the claims which follow hereinafter.

In particular, the receiving surfaces 46, 76, 106 of the wedge devices can be non-planar. For example, they can be convex, concave, or have serrations or cavities. The essential is to preserve an inclination slope.

Moreover, in the light of the description, it is to be understood that the invention also relates to a shim provided to be associated with the assembly 1.

The invention claimed is:

1. An assembly for mounting a boot onto a sporting device, the assembly comprising:

a free-heel binding structured and arranged to retain a user's boot on the sporting device;

the binding comprising:

a releasable locking mechanism to bind a front portion of the boot in relation to the sporting device;

a receiving surface configured to receive and engage at least a portion of the boot rearward of the locking mechanism;

a wedge device configured to support the binding on the sporting device along a slope extending longitudinally, in relation to a bottom surface of the sporting device, rearwardly and downwardly so that a front of a bottom of the user's boot is more greatly spaced from the bottom surface of the sporting device than a rear of the bottom of the user's boot;

the receiving surface of the binding is secured upon the wedge-shaped device against vertical movement in relation to the sporting device;

the wedge device having a forwardly-increasing thickness.

2. An assembly according to claim 1, wherein:

at least thickness-wise, the wedge device is made of a single continuous material.

3. An assembly according to claim 1, wherein:

the wedge device comprises a wedge-shaped shim comprising at least one section extending longitudinally from the rear end to the front end of the binding.

4. An assembly according to claim 3, wherein:

the wedge-shaped shim comprises a one-piece shim extending longitudinally from a rear end to a front end of the binding.

5. An assembly according to claim 3, wherein:

the receiving surface of the binding comprises a boot-supporting surface extending rearwardly to support a heel of the boot.

6. An assembly according to claim 5, wherein:

the wedge-shaped shim extends longitudinally from a rear end to a front end to support the user's boot beneath both a front portion and a heel of the boot.

7. An assembly according to claim 3, wherein:

the wedge-shaped shim has a slope between 0.2 and 5.0 degrees.

8. An assembly according to claim 3, wherein:

the wedge-shaped shim comprises a plastic material.

9. An assembly according to claim 3, wherein:

the wedge device comprises a wedge-shaped shim having through-holes for receiving screws structured and arranged to fix the wedge-shaped shim against movement in relation to the sporting device.

10. An assembly according to claim 1, wherein:

the binding further includes a base plate, the base plate being distinct from the wedge device;

the wedge device comprises:

a shim extending longitudinally from a rear end to a front end, transversely between a first edge and a second edge, and height-wise from a support surface to a receiving surface;

the shim having a height varying so as to increase from the rear end to the front end.

11. An assembly according to claim 10, wherein:

the support surface of the shim is flat and the receiving surface of the shim is flat.

12. An assembly according to claim 10, further comprising:

the sporting device, the sporting device comprising a gliding board;

the shim having a width between 80% and 120% of the width of the gliding board.

13. An assembly according to claim 10, wherein:

the shim has a number of openings greater than a number of retaining screws needed to secure the binding to the shim.

14. An assembly according to claim 10, wherein:

the sporting device is a cross-country ski;

the binding is a cross-country binding structured and arranged to allow a heel of the boot to be raised and lowered in relation to the ski.

15. An assembly according to claim 1, wherein:

the binding further comprises a base plate;

the base plate comprises said wedge device and has a thickness increasing forwardly.

16. An assembly according to claim 15, wherein:

the wedge device includes transversely extending notches structured and arranged to facilitate flexing of the wedge device along a transverse axis.

17. An assembly according to claim 1, further comprising:

the sporting device;

the sporting device comprising a binding receiving surface.

18. An assembly according to claim 17, wherein:

the sporting device is a ski.

19. An assembly according to claim 18, wherein:

the wedge device comprises a raised portion of the ski.

20. An assembly according to claim 19, wherein:

the raised portion of the ski includes the binding receiving surface;

the binding receiving surface includes a front limit and a rear limit.

21. An assembly according to claim 20, wherein:

the binding receiving surface includes a flat inclined extent;

the flat inclined extent of the binding receiving surface is an upper ski surface manifested by the ski having a thickness at a front of the flat inclined extent greater than a thickness at a rear of the flat inclined extent, so that the flat inclined extent of the binding receiving surface extends forwardly and upwardly in relation to a sole of the ski.

22. An assembly according to claim 1, further comprising:

a longitudinally extending and upwardly projecting boot-guiding rib, the rib being structured and arranged to be received within a longitudinal groove of the boot.

23. An assembly according to claim 22, wherein:

the rib extends longitudinally rearward of the reversible locking mechanism.

24. An assembly according to claim 1, wherein:

the receiving surface is a top surface of the wedge device.

25. An assembly according to claim 24, wherein:

at least thickness-wise, the wedge device is made of a single continuous material.

26. A boot-mounting assembly for mounting a boot on a sporting device, the assembly comprising:

a releasable locking mechanism configured to bind a front portion of the boot in relation to the sporting device while allowing free-heel movement of the boot in relation to the sporting device;

a receiving surface configured to receive the boot within a longitudinal area extending rearward of the locking mechanism;

a longitudinally extending wedge-shaped device configured to support the boot when the boot is received on the receiving surface;

the wedge-shaped device having a shape configured to incline the boot in a rearward and downward direction in relation to a bottom surface of the sporting device and between a front end and a rear end of the assembly;

the wedge-shaped device having a rigidity to secure the receiving surface against vertical movement in relation to the sporting device.

27. A boot-mounting assembly according to claim 26, wherein:

the wedge device comprises a wedge-shaped device having through-holes for receiving screws structured and arranged to fix the wedge-shaped device against movement in relation to the sporting device.

28. A boot-mounting assembly according to claim 27, wherein:

at least thickness-wise, the wedge-shaped device is made of a single continuous material.

29. A boot-mounting assembly according to claim 28, wherein:

the wedge-shaped device has a length extending at least from the releasable locking mechanism to a heel area of the assembly.

30. A boot-mounting assembly according to claim 28, wherein:

the receiving surface has a length extending at least from the releasable locking mechanism to a heel area of the assembly.

31. A boot-mounting assembly according to claim 26, further comprising:

a base plate carrying the releasable locking mechanism and the receiving surface;

the wedge-shaped device comprising the base plate.

32. A boot-mounting assembly according to claim 26, further comprising:

a base plate carrying the releasable locking mechanism and the receiving surface;

the base plate being directly affixed to the wedge-shape device.

33. A boot-mounting assembly according to claim 26, wherein:

the wedge-shaped device comprises a rigid material to support the boot against vertical movement toward the sporting device.

* * * * *